United States Patent [19]

Williams

[11] Patent Number: 5,020,612

[45] Date of Patent: Jun. 4, 1991

[54] WIRE LINE CORE DRILLING APPARATUS

[75] Inventor: David Stanley Williams, Krugersdorp, South Africa

[73] Assignee: Boart International Limited, South Africa

[21] Appl. No.: 483,024

[22] Filed: Feb. 22, 1990

[30] Foreign Application Priority Data

Feb. 22, 1989 [ZA] South Africa ..... 89/1364

[51] Int. Cl.[5] ..... E21B 25/02

[52] U.S. Cl. ..... 175/234; 175/236; 175/243; 175/246; 175/317

[58] Field of Search ..... 175/243, 246, 247, 234, 175/236, 317, 58, 324, 257, 403

[56] References Cited

U.S. PATENT DOCUMENTS

| | | | |
|---|---|---|---|
| 2,829,868 | 4/1958 | Pickard et al. | 175/246 |
| 3,103,981 | 9/1963 | Harper | 175/243 X |
| 3,120,282 | 2/1964 | Pickard | 175/247 |
| 3,120,283 | 2/1964 | Braun | 175/246 |
| 3,289,769 | 12/1966 | Nelson et al. | 166/326 |
| 3,305,033 | 2/1967 | Pickard et al. | 175/246 |
| 3,333,647 | 8/1967 | Karich et al. | 175/247 |
| 3,340,939 | 9/1967 | Lindelof | 175/246 |
| 4,281,725 | 8/1981 | Runk | 175/246 |
| 4,800,969 | 1/1989 | Thompson | 175/236 X |
| 4,832,138 | 5/1989 | Hallez | 175/243 X |
| 4,860,825 | 8/1989 | Corteville et al. | 166/68 |

FOREIGN PATENT DOCUMENTS

| | | | |
|---|---|---|---|
| 989302 | 5/1976 | Canada | 166/326 |
| 1148390 | 1/1987 | U.S.S.R. | 175/58 |

*Primary Examiner*—Hoang C. Dang

*Attorney, Agent, or Firm*—Wegner, Cantor, Mueller & Player

[57] ABSTRACT

A wire line core barrel inner tube assembly has a latch body with a miximum diameter portion providing a shoulder seatable on a drill string landing ring and a fluid bypass channel extending through the maximum diameter portion and a valving assembly. The valving assembly includes a resilient valve seat in the bypass channel and a ball seatable on the valve seat to block fluid flow in a downward direction through the channel, movable upwardly off the valve seat from the seated position to permit fluid flow through the seat in the opposite direction and movable through the seat to a channel open condition after a preselected fluid pressure has been exerted on the ball in a direction to move the ball from the ball seated position and through the valve seat.

2 Claims, 3 Drawing Sheets

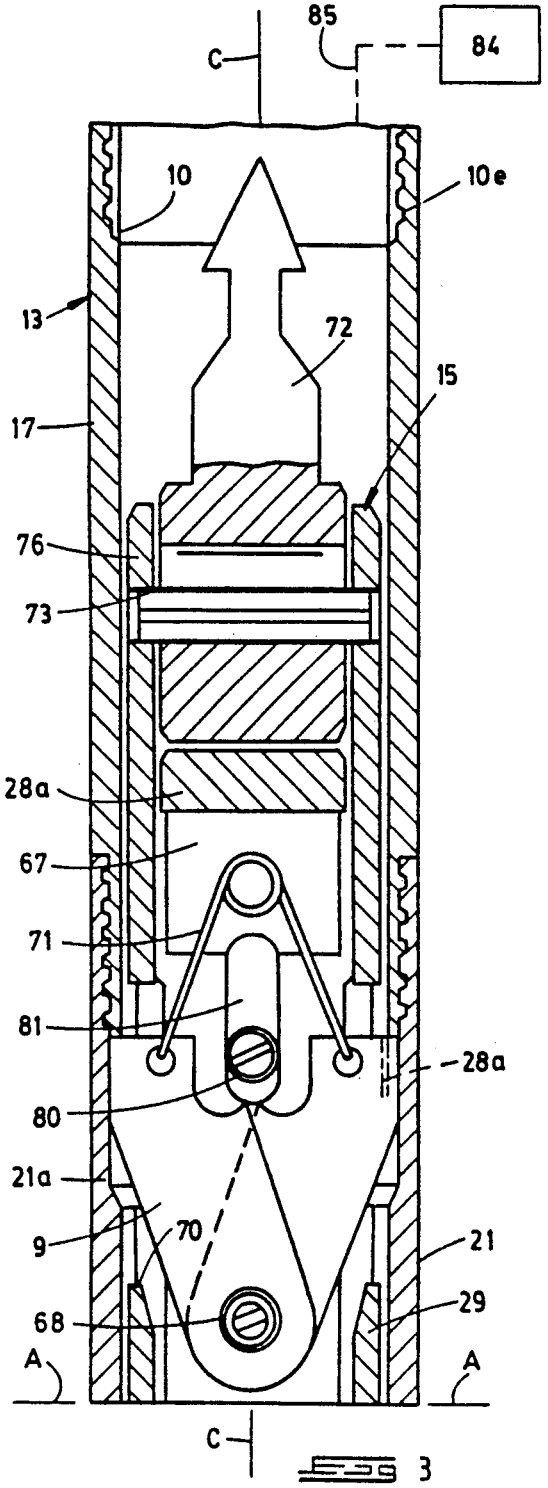
3
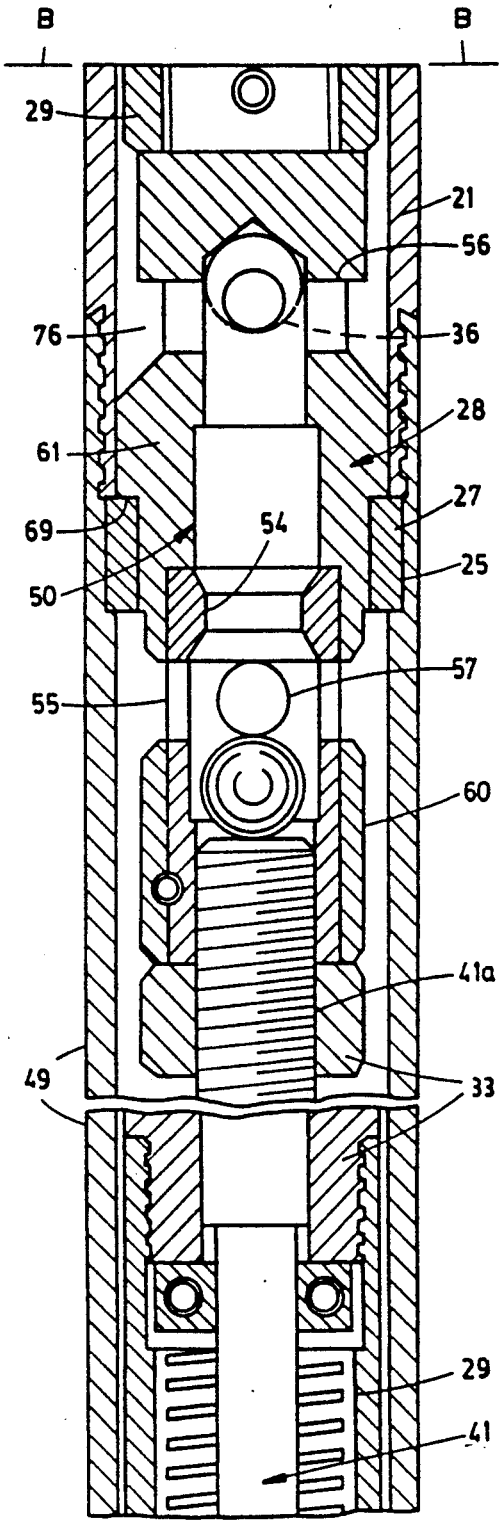
4

WIRE LINE CORE DRILLING APPARATUS

BACKGROUND TO THE INVENTION

This invention relates to wire line core drilling apparatus.

In wire-line core drilling, the core or inner tube assembly is dripped down the bore of a drill string to a position just behind the drill bit or crown. The assembly has a circumferential landing shoulder which, when the assembly is correctly positioned in the drill string, seats on a counter-shoulder or landing ring in the core barrel outer tube assembly. Spring-loaded latches on the assembly spring outwardly into an annular recess, known as the latch seat, in the inner surface of the outer tube assembly to anchor the assembly against axial movement in the bore. A liquid is pumped down the drill string to assist the movement of the core tube assembly to the correct position relative to the drill bit.

As drilling proceeds, a core of the drilled material is captured by the core receiving tube of the inner tube assembly. After a specified advance of the drill bit an operator on the surface lowers an overshot assembly down the drill string on the end of a wire line. The overshot assembly has jaws which engage with and lock onto a formation, known as a spear point overshot coupling member, on the upper end of the inner tube assembly. The wire line is then retracted, causing a latch retracting mechanism to pull the latches inwardly to release the inner tube assembly so that it can be pulled to the surface. On surface, the core is removed for geological analysis and the core tube assembly is then dropped down the drill string again, assisted by the liquid flow, in preparation for the taking of a deeper sample.

A major problem with this type of system is the inability of the surface operator to determine when the latches have anchored the inner tube assembly in position. Usually, the operator estimates when the correct position of the inner tube assembly has been attained merely by timing the descent of the assembly in the drill string. If for some reason the inner tube assembly is not properly landed and latched, the core which is obtained may be broken and unsuitable for an accurate analysis thereof to be made. Furthermore, a great deal of time is lost if the inner tube assembly is not latched because core then cannot be retrieved by means of the wire line system. The drill string has to be removed from the hole and possibly a "fishing operation" has to be conducted to recover the core.

SUMMARY OF THE INVENTION

A first aspect of the invention provides a wire line core barrel inner tube assembly comprising a body, a landing shoulder on the body for seating, when the inner tube assembly is correctly landed in a drill string, upon a landing ring carried by the drill string, a valve chamber in the body, an inlet port and an outlet port leading from the exterior of the body to the valve chamber on opposite sides of the shoulder, the ports and the valve chamber establishing a bypass passage which bypasses the shoulder and through which liquid fed through the drill string is obliged to flow when the shoulder is seated upon the landing ring, a valve seat in the bypass passage and a valve closure which is seatable on the valve seat to prevent liquid flow through the bypass passage from the inlet port to the outlet port until the pressure of the liquid is high enough to force the closure past the valve seat to open the bypass passage to such liquid flow.

Preferably at least one of the valve closure and the valve seat is resiliently deformable to permit the closure to be forced by liquid pressure past the seat.

The valve seat may be in the form of a resiliently deformable ring and the closure in the form of a relatively hard ball having a diameter greater than the inner diameter of the ring when the ring is relaxed. Alternatively the ball is resiliently deformable and the ring is relatively hard.

Advantageously, the valve chamber is sized to permit the valve closure to be moved by the liquid away from the valve seat, when the inner tube assembly is moving in the drill string towards the landed position, to a position permitting liquid flow to take place through the bypass passage in a reverse direction extending from the outlet port to the inlet port.

A second aspect of the invention provides a wire line core drilling apparatus which comprises the inner assembly summarised above, means for feeding liquid along the drill string along with the inner tube assembly and means for providing a discernible indication of a rise in the pressure of the liquid that is itself indicative of seating taking place between the shoulder and the landing ring and hence between the valve closure and the valve seat.

A third aspect of the invention provides a latch body for a wire line core barrel inner tube assembly, the latch body comprising spring loaded latches for engaging a latch seat in a drill string when the inner tube assembly is correctly landed in the drill string, a circumferential shoulder for seating upon a landing ring in the drill string when the inner tube assembly is correctly landed in the drill string, a valve chamber in the latch body, an inlet port and an outlet port leading from the exterior of the latch body to the valve chamber, the ports and the valve chamber establishing a bypass passage through the latch body which bypasses the landing shoulder and through which liquid fed along the drill string is obliged to flow when the landing shoulder is seated on the landing ring, and a valve seat in the valve chamber against which, in use, a valve closure provided in the valve chamber can seat to prevent liquid from flowing through the bypass passage from the inlet port to the outlet port and through which the valve closure can be forced by the pressure of the liquid when that pressure is high enough.

BRIEF DESCRIPTION OF THE DRAWINGS

The invention will now be described in more detail, by way of example only, with reference to the accompanying drawings in which:

FIGS. 3 and 4 in combination, with the lines A—A and B—B aligned, show in more detail a cross-section through the upper part of a core barrel inner tube assembly of a second embodiment of the invention;

DESCRIPTION OF THE FIRST EMBODIMENT

Figure 1:
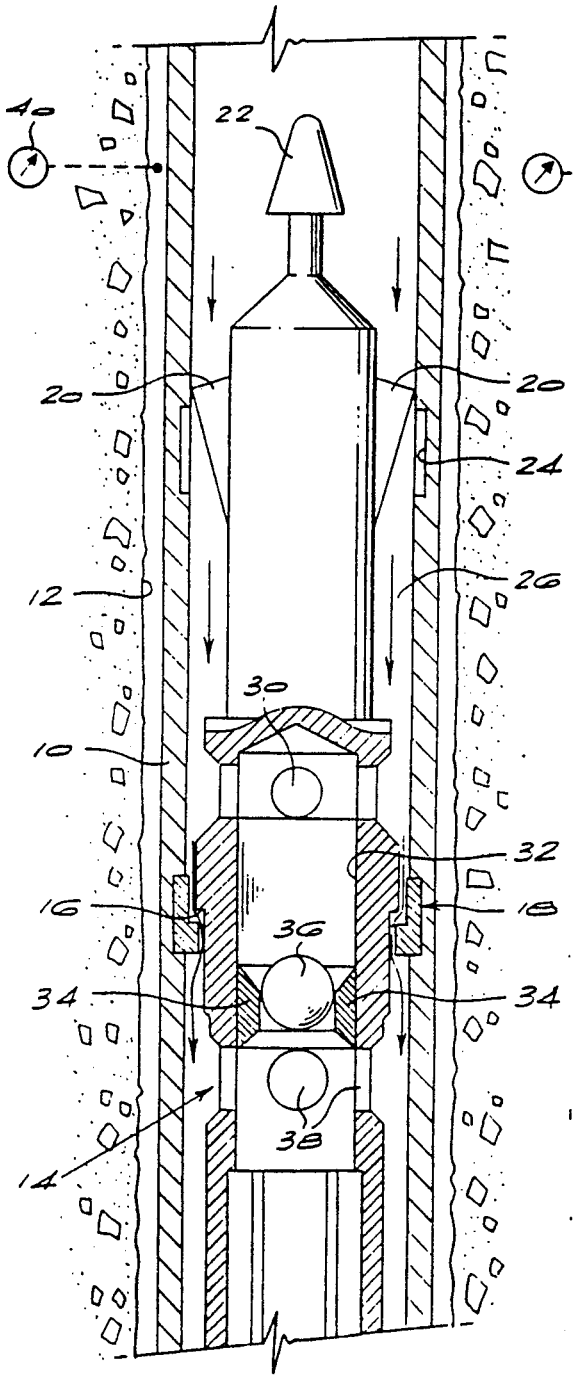
FIG. 1 shows a somewhat diagrammatic side view, partially cross-sectioned, of a first embodiment of the invention just prior to landing of the inner tube assembly.

FIG. 1 shows a drill string 10 composed of a series of interconnected hollow drill tubes. The drill string 10 is in a hole 12 drilled in rock or other earth formation by means of a drill bit corresponding to the bit 11 seen in FIG. 5. The illustrated portion of the drill string 10 is located just behind the bit in the drilled hole 12 and may be at a considerable depth below the surface.

Figure 2:
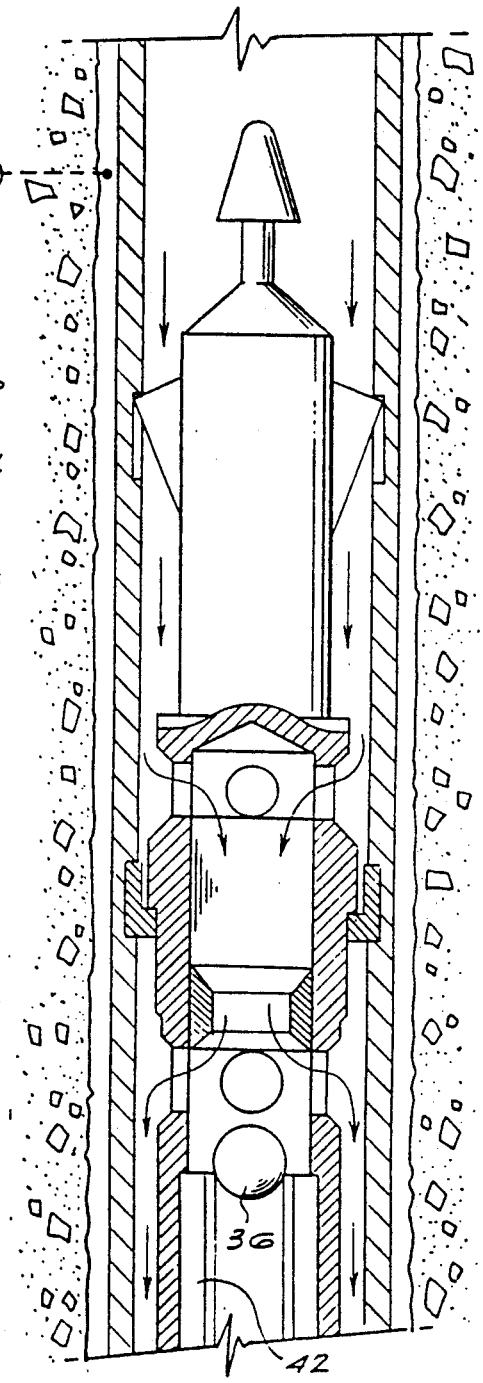
FIG. 2 shows a corresponding view of the first embodiment after landing of the inner tube assembly.

Inside the drill string 10 is a core barrel inner tube assembly 14 of which only those parts relevant to the present invention are illustrated in FIGS. 1 and 2. Non-illustrated parts of the drill string and inner tube assembly in FIGS. 1 and 2 may be taken as entirely conventional.

The core barrel inner tube assembly 14 has a circumferential landing shoulder 16 and the drill string has a counter-shoulder provided by an annular landing ring 18. The core barrel inner tube assembly also has a pair of spring-loaded latches 20 which are biased radially outwardly by means of an internal spring (not illustrated in FIGS. 1 and 2). A spear point overshot coupling member 22 is located at the upper end of the inner tube assembly, and is engageable by jaws at the end of an overshot assembly carried by a wire line.

In use, the inner tube assembly 14 is dropped, from the surface, down the bore of the drill string. When the inner tube assembly is correctly positioned relative to the drill string for a coring operation to take place, the landing shoulder 16 abuts the landing ring 18 and further movement of inner tube assembly is prevented. When this condition of correct landing has been attained, the latches 20 spring outwardly and locate in an annular recessed latch seat 24 in the wall of the drill string, thereby anchoring the assembly within the bore of the string. To assist the inner tube assembly in dripping down the bore of the drill string to the correct landed position, and also to provide a flushing action once drilling has commenced, a flushing liquid, typically water, is flushed under pressure down the bore of the drill string from the surface. The liquid flows in the annular space 26 between the wall of the drill string and the outer surface of the inner tube assembly.

The arrows in FIG. 1 illustrate the path taken by the flushing liquid before the condition of correct landing takes place between the shoulder 16 and the landing ring 18. However, as soon as the shoulder 16 contacts the landing ring 18, the flushing liquid is prevented from flowing through the annular space 26 downstream of the should and landing ring. Ports 30 positioned upstream of the shoulder 16 lead the liquid flow into a hollow bore 32 in the inner tube assembly. In the bore 32, there is an annular nylon valve seat 34 which is fixed relative to the chamber or bore 32, and a valve closure in the form of a hard ball 36. The nylon of the bush has a degree of resilience.

Downstream of the ring 34 are further ports 38 which lead from the interior of the bore 32 back into the annular space 26 surrounding the inner tube assembly.

The ball 36 initially seats (under gravity) on the valve seat 34 and prevents liquid flow through the passage defined by the ports 30, the bore 32 and the ports 38. The liquid pressure builds up until the force exerted on the ball is sufficient to force it past the valve seat 34, which deforms resiliently to permit such passage. The liquid is now able to flow through the valve seat and out through the ports 38, effectively by-passing the landed shoulder 16 and the landing ring 18. The arrows in FIG. 2 illustrate the liquid flow path in this situation.

On the surface, associated with the source of flushing liquid, is a pressure gage 40 which is monitored by the surface operator. When the operator detects a sudden rise in liquid pressure, he knows that the shoulder 16 has landed on the landing ring 18, and that the inner tube assembly is correctly posited for a coring operation. As soon as he sees a subsequent pressure drop, he knows that the valve constituted by the valve seat 34 and ball 36 has opened i.e. the ball has been pushed past the valve seat, and that normal liquid flow to the drill bit has resumed. At this stage, a core drilling operation can be started. A further aid to the operator is a pressure gauge fitted with a "maximum pointer". This indicates the maximum pressure reached until the pointer is reset. The pressure pulse may only last for a few seconds and could otherwise by missed by the operator.

The ball 36 clearly has a diameter which is somewhat greater than the internal diameter of the valve seat 34 when the latter is relaxed. Also, the ball 36 has a diameter somewhat greater than the internal diameter of a downstream sleeve 42 in the inner tube assembly. Thus the movement of the ball, after it has been pushed through the bush, is arrested by the sleeve as illustrated in FIG. 2.

Once the core sample has been taken, the surface operator lowers the wire line down the bore of the drill string. The jaws of the overshot assembly at the end of the wire line lock onto the coupling member 22 at the end of the inner tube assembly. The operator then retracts the wire line in the normal way, which causes the conventional latch release mechanism to draw the latches 20 inwardly to release them from the latch seat 24. A continued pull on the wire line draws the entire inner tube assembly to the surface for extraction of the core. At the surface, the ball 36 is forced back through the valve seat to the position seen in FIG. 1, and the inner tube assembly can be dropped back down the drill string for the taking of a deeper core sample.

DESCRIPTION OF THE SECOND EMBODIMENT

The second embodiment of the invention shown in FIGS. 3-8 incorporates features of the first embodiment and shows greater detail of a core barrel inner tube assembly incorporating the present invention. Referring to these Figures a pump apparatus indicated by block 84 pumps liquid under pressure through a line 85 into the upper end of the drill string 10 in a conventional manner.

The portion of the drill string that is attached to and extends below the drill tube 10*a* is hereinafter referred to as a core barrel outer tube assembly, generally designated 13. The core barrel outer tube assembly 13 is provided for receiving and retaining the core barrel inner tube assembly, generally designated 15. The construction of the core barrel outer tube assembly may be such as that disclosed in U.S. Pat. Nos. 3,120,282 and 3,120,283. The outer tube assembly is composed of a core barrel outer tube 49, a reaming shell 19 connected to the lower end of the tube 49 and an annular drill bit 11 at the lower end of the reaming shell for drilling into the rock or earth formation from which the core sample is to be taken.

The upper end of the assembly 13 includes a locking coupling 17 that connects the assembly 13 to the adjacent drill tube 10*a* of the drill string. At the opposite end of the coupling 17 from the drill tube 10*a*, an adaptor coupling 21 is connected. The lower end of the locking coupling in conjunction with an annular recess 21*a* in the coupling 21 form a latch seat 21*a* in which the latches 9 of the inner tube assembly locate when the inner tube assembly is in a correctly landed position.

The lower end portion of the locking coupling 17 has a projecting flange 28*a* which extends as a partial cylindrical surface. This flange bears against a latch 9 to cause the latches and other parts of the inner tube assembly to rotate with the drill string when the latches are in a latched position. The outer tube 49 where it is threadedly connected to the coupling 21 is provided with an annular recess 25 for mounting a landing ring 27.

The core barrel inner tube assembly 15 includes a latch body 28 with the latches 9 mounted thereon at a pivot 68, a latch release tube 29 for retracting the latches, a core receiving tube 31, an inner tube cap 33 threaded into the upper end of the core receiving tube 31, and a spindle and bearing subassembly 41 for connecting the cap to the lower portion of the latch body for limited sliding movement relative to the cap by structure still to be described. The core receiving tube 31 has a replaceable core lifter case 37 and a core lifter 35, the structure and function of which may be generally the same as set out in U.S. Pat. No. 2,829,868.

Figure 5:
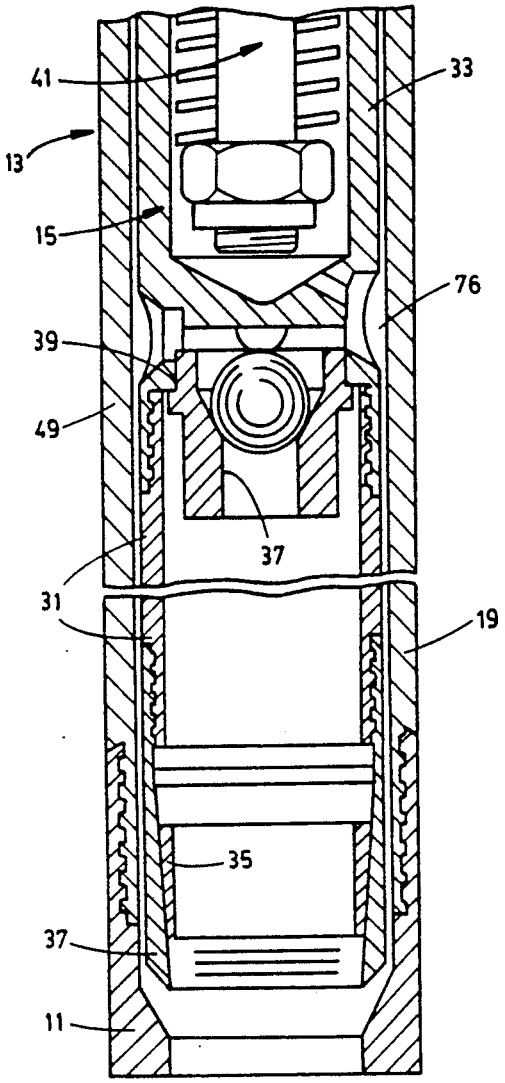
FIG. 5 shows a view corresponding to that of FIGS. 3 and 4 of the lower part of the core barrel inner tube assembly.
Figure 6:
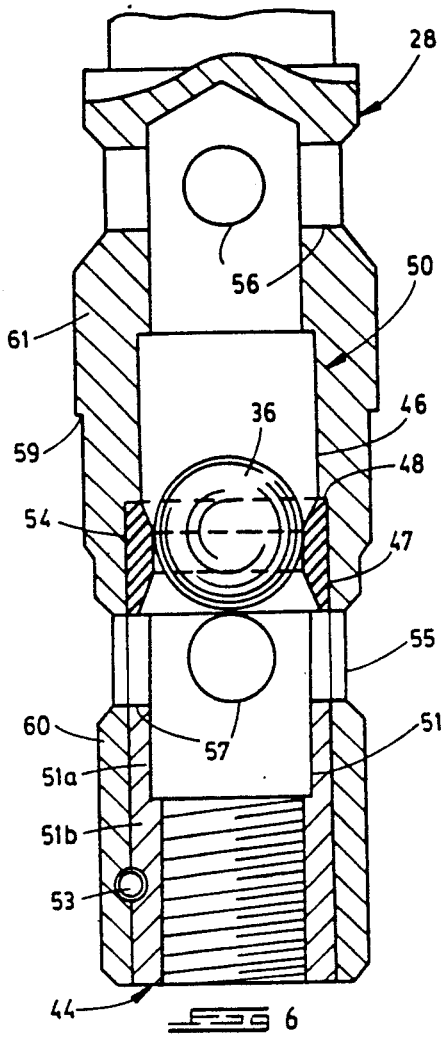
FIG. 6 shows a cross-sectional view of the lower part of the latch body with the valve mechanism closed.
Figure 7:
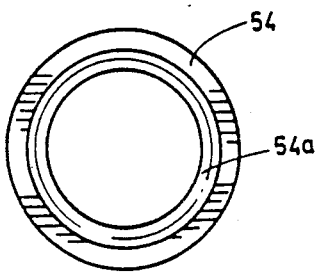
FIGS. 7 and 8 respectively show plan and cross-sectional views of the valve seat member.
Figure 8:
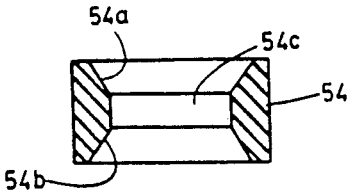

A fluid passageway 39 formed in the cap 33 opens through a valve subassembly to the interior of the upper end of the core receiving tube 31 and at the opposite end to the annular clearance space between the inner tube assembly 15 and the outer tube 49 that forms a part of an annular fluid channel 76. The channel 76, in conjunction with the bypass channel still to be described, permits fluid to bypass the inner tube assembly when in a core taking position such as is illustrated in FIGS. 3 to 5. The cap 33 is mounted by the spindle-bearing subassembly 41, the subassembly 41 and the manner of the mounting thereof being very similar to that described in greater detail in U.S. Pat. No. 3,305,033.

A plurality of circumferentially spaced, transverse ports 56 are provided in the latch body. At one end, they open through a maximum diameter portion 61 of the latch body into the fluid channel 76 between the inner tube assembly and the outer tube assembly. At their opposite ends they open into the upper end portion of the axial bore of the latch body, generally designated 50. A second plurality of ports 55 are formed in the latch body open through an intermediate portion of the latch body situated below the downwardly facing, annular landing shoulder 59 of the latch body. At their opposite ends the ports 55 are open to the axially intermediate portion 46 of the bore 50. The ports 56, the intermediate portion 46 of the bore 50, the ports 55 and the structure to be described and mounted in the bore 50 provide a fluid bypass channel to bypass the shoulder 59 and the landing ring 27 when the inner tube assembly is in the landed, latch seated position of FIGS. 3 to 5 and to permit fast descent as will be described.

A bypass valve assembly, generally designated 44, is mounted in the lower portion 47 of the latch body bore 50. An annular valve seat in the form of a resilient deformable ring 54 is mounted in the lower bore portion 47 with its upper annular surface abutting against a downward facing shoulder 48 formed ta the intersection o the bore portions 46 and 47 of the latch body bore 50. The minimum diameter of the ring 54, i.e. at the location 54*c*, is less than the inner diameter of the bore portion 46. The opposite annular surface of the ring 54 abuts against the upper annular edge of a fitting 51 which is of an outer diameter to form a close fit within the bore portion 47. The fitting is removably retained in the bore 50 by a removable transverse roll pin 53 extending within facing grooves and a hole in the fitting and latch body. The upper end portion 51*a* of the fitting has outlet ports 57 in radial alignment with the latch body ports 55. The ports 57, a portion of the fitting 51 and the ring 54 form a part of the fluid bypass channel through which fluid can flow when the bypass valve assembly 44 is open. The inner diameter of the portion 51*a* of the fitting 51 is greater than the minimum diameter of the ring 54.

The lower end portion 51*b* of the fitting 51 is internally threaded and has a maximum inner diameter smaller than the inner diameter of the fitting upper end portion 51*a*. The lower edge of the fitting 51 is flush with the lower edge of the latch body 28. The lower end portion 51*b* of the fitting 51 is threaded to engage the upper threaded end portion 41*a* of the spindle subassembly 41.

The valve seat, i.e. the ring 54, is made of resilient material, for example nylon, and has its upper and lower internal surface portions 54*a* and 54*b* respectively of generally frustoconical shape to facilitate the movement of the hard valve ball 36 downwardly and upwardly respective through the ring when sufficient force is exerted on the ball in the appropriate direction. The diameter of the ball 36 is slightly greater than the minimum diameter of the intermediate portion 54*c* of the ring in a relaxed condition, but is less than the inner diameters of the upper end portion of the bore 50 into which the ports 56 open and the inner diameter of the fitting portion 51*a*. Thus it is possible for the ball 36 to move upwardly to the top end of the bore 50 (to the dotted line position 36*a* of FIG. 4) to permit fluid flow inwardly through the ports 57 and outwardly through the ports 56, and similarly to move downwardly through the ring 54 to seat on the upper end of the spindle assembly 41 or the intersection of the fitting portions 51*a*, 51*b* (i.e. the solid line position of FIG. 4) to permit fluid bypass in a downward direction from the port 56 to the ports 57.

A slot 67 is formed in the latch body for mounting the latches 9 in side by side relationship. The latch release tube 29 has a slot 70 for each latch 9 to extend through to seat in the latch seat 21*a*. A spring 71 resiliently urges the latches to their latch seated positions. A spear point overshot coupling member 72 is mounted at the upper end of the latch release tube 76 by a pin 73 and is engageable by the jaws of an overshot assembly (not shown) for retracting the core barrel inner tube assembly 15. It is to be understood that coupling members of types other than those illustrated may be used. The function of a locking pin 80 that is mounted by the latch release tube and is extended through slots 81 is described in U.S. Pat. No. 4,281,725.

The second embodiment may be used in the same manner as the first embodiment. With the second embodiment a conventional wire line core barrel inner tube assembly may be easily converted to one incorporating the present invention. For example by enlarging the diameter of the lower end portion of the axial bore in the latch body of U.S. Pat. No. 3,333,647 and providing a hole, if not already available, for a transverse opening for a through pin, the fitting, valve ring, valve ball and through pin 53 of appropriate lengths and diameters can be mounted in the modified latch body, and the spindle assembly of the patent may be mounted by the fitting 51 without any additional changes being made to incorporate the present invention in a convention inner tube assembly. Alternately a latch body or a lower latch body part incorporating the present invention may be sold as a kit for replacing the latch body of an existing core barrel inner tube assembly.

In the event that the latch body is made in two parts threadedly connected to one another, such as disclosed in U.S. Pat. No. 3,305,033, then a kit that includes a lower latch body portion incorporating the fitting, through pin, ring 54 and valve ball 36 of the present invention may be sold to replace the lower latch body portion.

With reference to both embodiments, when the inner tube assembly is dropped into the drill string, and as drilling liquid is pumped into the drill string, the inner tube assembly 14, 15 will usually drop faster than the rate of flow of the liquid pumped into the drill string. As a result liquid below the latch body flows into the exit ports 38, 55 and the bore 32, 50 to force the ball upwardly relative to the latch body to abut against the upper end of the bore 32, 50. If the part of the bore 32, 50 above the valve seat is of a sufficiently large diameter, the ball can move above the valve seat such that liquid can flow upwardly through the valve seat and exit through the ports 30, 56 and into the fluid channel between the latch release tube and the drill string. The usual clearance between the drill string and the outer surface of the latch body is relatively small, other than at the latch seat 21, 24 and the portion 61 is of a larger diameter than any other circumferential part of the core barrel inner tube assembly. If the bypass feature referred in this paragraph were not provided, the rate of descent of the assembly 14, 15 in the drill string would be substantially slower.

With reference to both embodiments, after the ball has been moved under fluid pressure to the valve open position of FIGS. 2 and 4 and the inner tube assembly has been removed from the bore hole, for example with the inner tube assembly tilted so that the ball rolls to be located adjacent the valve ring, an appropriate tool, such as a tapered bar or rod (not shown) is inserted into one of the ports 38, 57 and is then moved to force the ball back through the ring.

Even through the invention has primarily been described with reference to the valve seat being resiliently deformable, either embodiment may incorporate a rigid valve seat and a valve member which is deformable under sufficient force to pass through the valve seat as previously described. If the valve seat is made of metal it may be integrally formed as a part of the lower latch body portion or as a separate metal part suitable permanently fixed to the latch body. In such an event the deformable ball, for example, can be pushed through the latch body spindle body opening, or the latch body bore can be extended through the upper end thereof and have a removable plug (not shown) to close the upper end portio of the axially extended bore.

Further, even through the invention has been described relative to the wire line assembly tool being a core receiving tube connected to the lower end of the spindle, it is to be understood that other type tools can be connected thereto, for example a non-annular plug bit.

The valve ring and ball are of materials and relative sizes that for example a pressure of 2 to 2.8 MPa is required to push the ball from the valve closed position through the valve ring and to the valve open position. Further as an example of one form of the invention, but not otherwise as a limitation thereon, the ball may be a steel ball of a diameter of about 22 mm and the minimum diameter of the valve seat about 21.7 mm.

It should be noted that the invention has application to non-vertical holes as well as bore holes that extend primarily in a vertical direction. For example, when drilling a horizontal hole, some driving means would be required to move the inner tube assembly through the drill string toward the drill bit and usually a spring device would be required to urge the ball towards the valve seat.

Not previously mentioned is that the ball of each of the embodiments is of a sufficiently larger diameter than each of the ports 30, 36 and 55 to 57 that it cannot be forced by liquid pressure radially outwardly through the ports during use in coring operations under usual operating conditions, even if the ball is made of resilient material and the valve seat is made of a hard material.

I claim:

1. A core barrel inner tube assembly for a wire line core drilling apparatus, comprising:

a body having a valve chamber;

seating means comprising a landing shoulder on the body for seating upon a landing ring carried by a core barrel outer tube of the wire line core drilling apparatus when the core barrel inner tube assembly is correctly landed in the core barrel outer tube;

an inlet port and an outlet port leading from an exterior portion of the body to the valve chamber on opposite sides of the landing shoulder so as to establish a bypass passage which bypasses the landing shoulder and through which drilling liquid is forced to flow when the landing shoulder is correctly seated upon the landing ring;

a deformable, annular valve seat disposed within the bypass passage;

valve closing means made of harder material than the valve seat for seating on the valve seat to prevent drilling liquid from flowing through the bypass passage until pressure of the drilling liquid is sufficient to force the valve closing means through the valve seat; and pressure monitoring and recording means for monitoring an increase in the pressure of the drilling liquid and for recording a pulse in the pressure indicating that correct landing has taken place;

wherein said valve seat comprises a central region having a diameter less than that of the valve closing means, and tapered end regions which facilitate forcing of the valve closing means through the valve seat from either end.

2. A core barrel inner tube assembly as claimed in claim 1, wherein the body is a latch body carrying spring loaded latches adapted to engage the core barrel outer tube when the landing shoulder is correctly seated on the landing ring.

* * * * *